United States Patent [19]

Tomoyori et al.

[11] Patent Number: 4,768,056

[45] Date of Patent: Aug. 30, 1988

[54] IMPACT PRINTER AND COPIER

[75] Inventors: Makoto Tomoyori, Iwate; Sunao Hatanaka, Takizawa, both of Japan

[73] Assignee: Alps Electric Co., Ltd., Japan

[21] Appl. No.: 98,789

[22] Filed: Sep. 21, 1987

[30] Foreign Application Priority Data

Nov. 27, 1986 [JP] Japan ..... 61-280714

[51] Int. Cl.[4] ..... G03G 15/00

[52] U.S. Cl. ..... 355/3 R; 355/3 SH; 355/133; 101/1

[58] Field of Search ..... 355/3 R, 3 BE, 3 SH, 355/14 R, 16, 19, 133, 1, 3 TR; 101/DIG. 22, DIG. 28, 1, 113, 287; 346/74.2, 153.1

[56] References Cited

U.S. PATENT DOCUMENTS

| | | | |
|---|---|---|---|
| 4,544,258 | 10/1985 | Takano | 355/1 |
| 4,553,148 | 11/1985 | Behrens et al. | 355/3 R X |
| 4,593,991 | 6/1986 | Aoki et al. | 355/14 D |
| 4,660,961 | 4/1987 | Kuramoto et al. | 355/3 R X |
| 4,674,856 | 6/1987 | Hyodo et al. | 355/1 |
| 4,674,857 | 6/1987 | Satomura et al. | 355/3 R |

*Primary Examiner*—A. C. Prescott

*Attorney, Agent, or Firm*—Guy W. Shoup; Paul J. Winters

[57] ABSTRACT

A printer wherein impact printing and non-impact printing can be effected selectively as required. The printer comprises a print head of the impact type and a platen located in an opposing relationship to define a print position in a printer body. A paper transport device is mounted on the printer body and includes a paper supply section for supplying a paper sheet from a supply paper tray to the print position, and a paper discharging section for discharging a paper sheet from the print position onto a discharge paper tray. A developing unit is located between the paper supply and discharging stations and includes a latent image forming belt, and a transfer station for transferring a toner image formed on the belt to a paper sheet. A paper path for passing a paper sheet through the transfer station is formed in the developing unit. A fixing device is located outside the developing unit for fixing a toner image on a paper sheet discharged from the developing unit to a surface of the paper sheet.

9 Claims, 4 Drawing Sheets

IMPACT PRINTER AND COPIER

BACKGROUND OF THE INVENTION

This invention relates to a printer, and more particularly to a printer wherein impact printing and non-impact printing can be selectively effected as required by a combination of a developing unit for forming a toner image with a print head of the common impact type.

Generally, printers are divided roughly into those of the impact type as represented by a wire dot printer and those of the non-impact type as represented by an electrophotographic printer. Printers of the impact type have a characteristic that they are suitable for printing with a plurality of copies while printers of the non-impact type have a characteristic that they have a high resolution and allow printing at a relatively high speed.

Meanwhile, some of printers of the impact type of a high grade in recent years are provided with a paper transport device which automatically supplies one after another of paper sheets stored in a pile in a supply paper tray to a position between a print head and a platen and discharges a paper tray after printing onto a discharge paper tray.

However, since conventional printers are either of the impact type or the non-impact type as described above, it is impossible for both of them to selectively make the most of the characteristics of both types.

SUMMARY OF THE INVENTION

It is an object of the present invention to provide a printer wherein impact printing and non-impact printing can be performed alternatively as required.

According to the present invention, a printer of the type which includes a printer body in which a print head is located in an opposing relationship to a platen, and a paper transport device mounted on said printer body and including a paper supply section for supplying one of paper sheets of a predetermined width stored in a pile on a supply paper tray to a print position between said print head and said platen in said printer body, and a paper discharging section for discharging a paper sheet from the print position onto a discharge paper tray, comprises a developing unit located between said paper supply station and said paper discharging station of said paper transport device and including a latent image forming means in the form of a belt having a smaller width than the width of the paper sheets, a transfer station for transferring a toner image formed on said latent image forming means to a paper sheet, and means defining a paper path for passing a paper sheet through said transfer station, and a fixing device located outside said developing unit for fixing a toner image on a paper sheet discharged from said developing unit to a surface of the paper sheet.

In the printer of the present invention, when a plurality of print copies are required, impact printing may be effected on a plurality of overlapping paper sheets by introducing the paper sheets into the printer body. To the contrary, when printing of a complicated material such as a drawing is intended, non-impact printing can be effected by passing a paper sheet through the developing unit. Accordingly, the advantages of both printing methods can be made most of.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
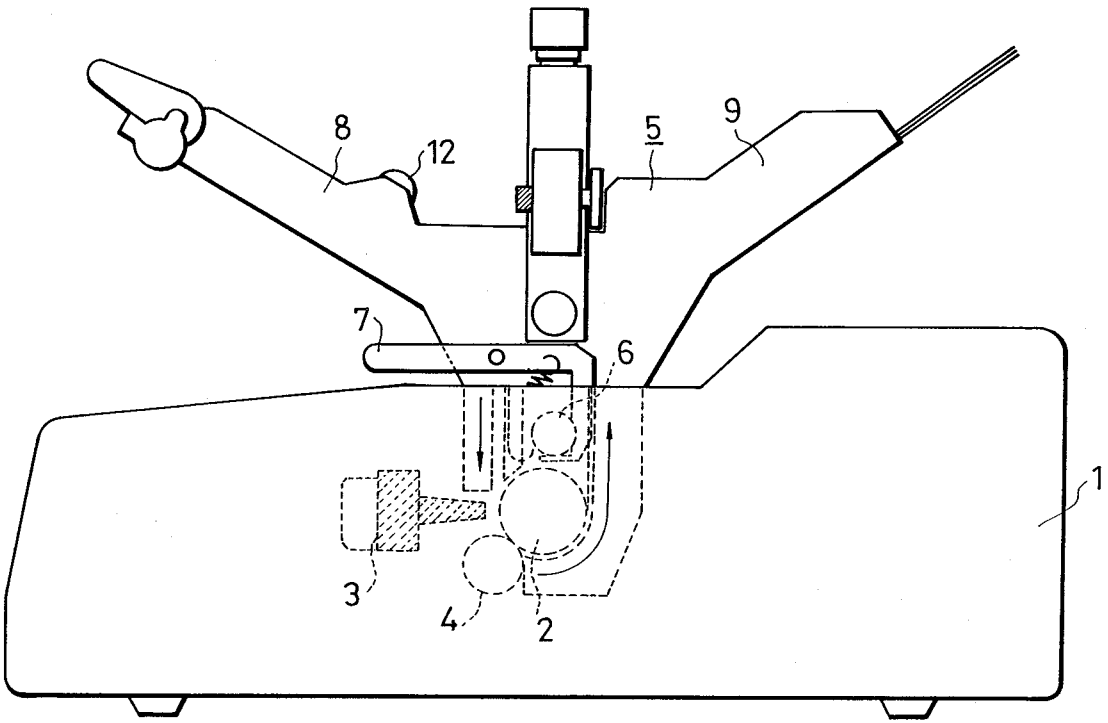
FIG. 1 is a front elevational view, partly in section, of a printer showing an embodiment of the present invention.

Referring first to FIG. 1 which shows an entire printer according to the present invention, the printer shown includes a printer body 1, a platen 2 located in the printer body 1, and a print head 3 of the dot wire type or the daisy wheel type located in an opening relationship to the platen 2 in the printer body 1. A transport roller 4 is in contact under pressure with the platen 2 and transports one after another of paper sheets to a print position between the platen 2 and the print head 3.

Figure 2:
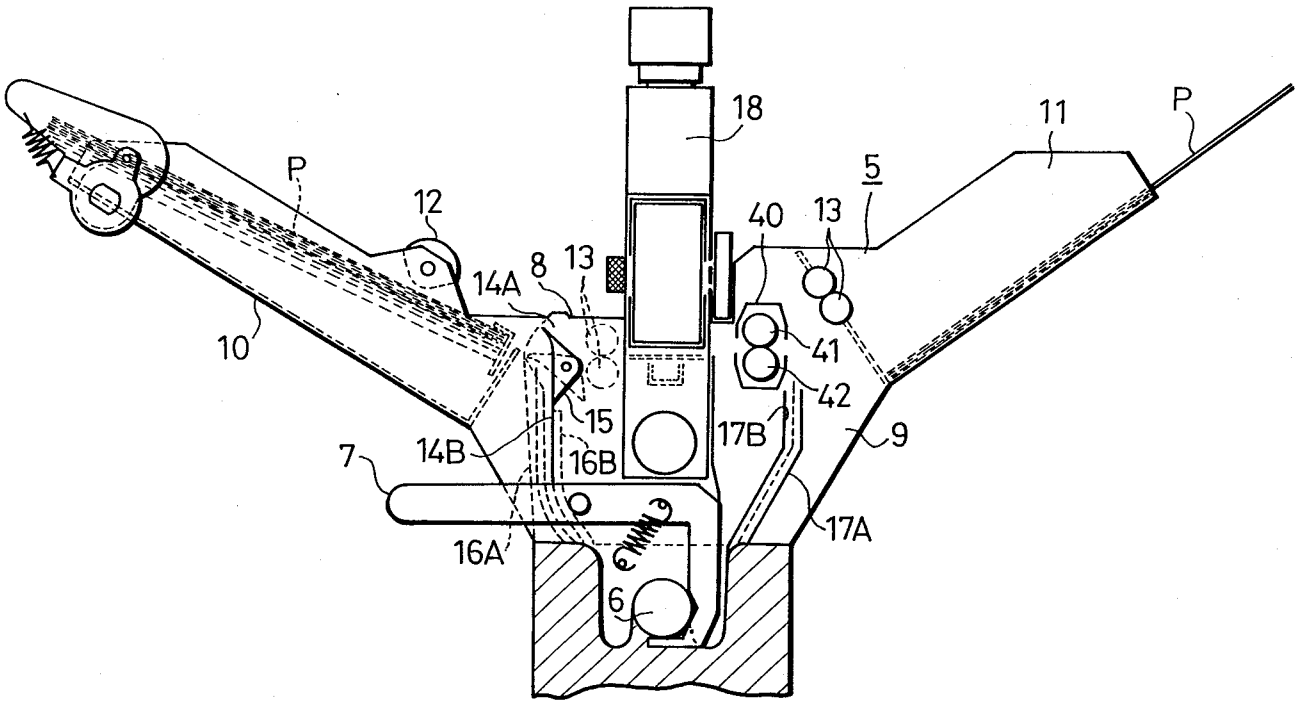
FIG. 2 is an enlarged front elevational view of a paper transport device of FIG. 1.

Referring to now FIG. 2, a paper transport device 5 is located above and mounted on the printer body 1 by means of an L-shaped securing member 7 which engages with a support shaft 6 located in the printer body 1 under an urging force of a spring. The paper transport device 5 has a paper supply section 8 and a paper discharging section 9 arranged in respective inclined positions such that those ends of the sections 8 and 9 adjacent the platen 2 may be located at lower positions than the other ends. A supply paper tray 10 is formed at an upper end portion of the paper supply section 8 while a discharge paper tray 11 is formed at an upper end portion of the paper discharging station 9. A paper supply roller 12 is located above the supply paper tray 10 and delivers paper sheets P stored in a pile in the supply paper tray 10 one after another from the top of the pile of the paper sheets P. Meanwhile, a pair of transport rollers 13 are located in the discharge paper tray 11 and are rotated in opposite directions to introduce a paper sheet P into the discharge paper tray 11.

The paper supply section 8 has formed therein a paper path 14A for transporting a paper sheet P forwarded from the supply paper tray 10 substantially in a horizontal direction toward the paper discharging section 9, and another paper path 14B for transporting a paper sheet P substantially in a vertical direction toward the interior of the printer body 1. Another pair of transport rollers 13 are located in the paper path 14A. A change-over pawl 15 for selecting one of the paper paths 14A, 14B is mounted for pivotal motion at a portion of the paper supply section 8 forwardly of the supply paper tray 10. A pair of guide members 16A, 16B for introducing a paper sheet P forwarded into the paper path 14B of the paper supply station 8 to a position between the platen 2 and the print head 3 are formed in the paper transport device 5 below the change-over pawl 15. Another pair of guide members 17A, 17B for introducing a paper sheet P passing between the platen 2 and the print head 3 to the paper discharging section 9 are also formed in the paper transport device 5.

Figure 3:
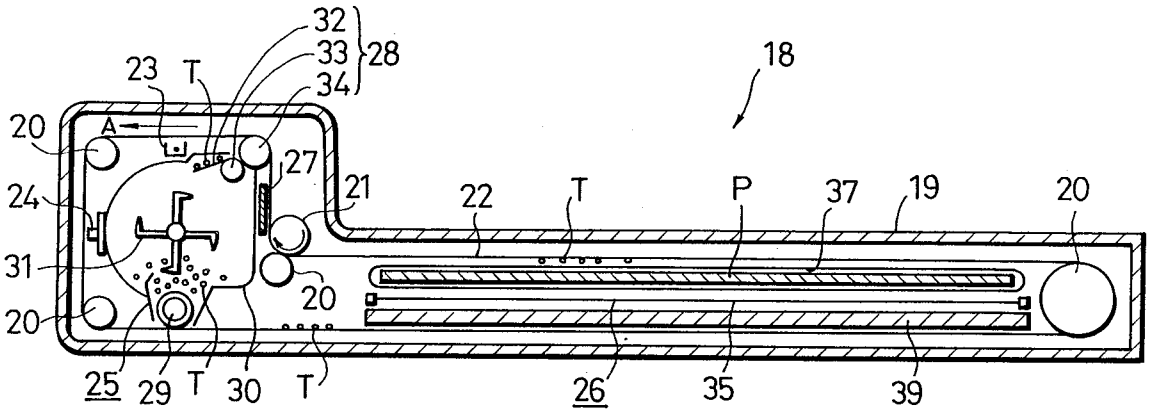
FIG. 3 is a vertical sectional side elevational view of an electrophotographic processing unit of FIG. 2.
Figure 4:
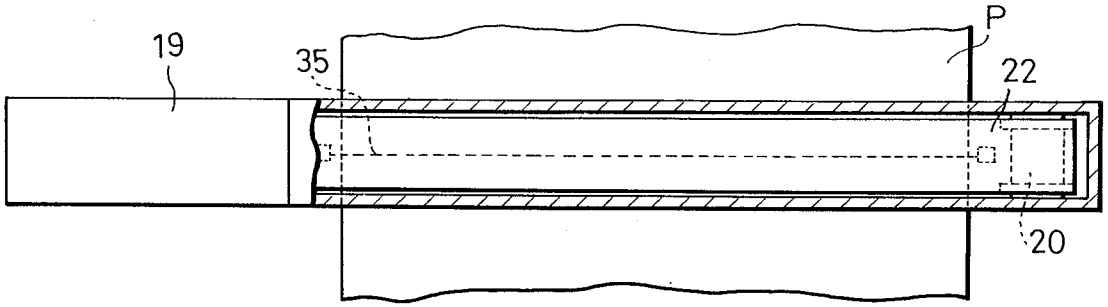
FIGS. 4 and 5 are a plan view and a front elevational view, respectively, partly in section, of the electrophotographic processing unit of FIG. 3.
Figure 5:
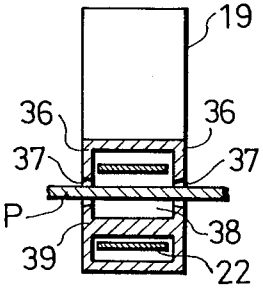

An electrophotographic processing unit 18 as an example of developing unit is located between the paper supply section 8 and the paper discharging section 9 of the paper transport device 5. Referring now to FIGS. 3 to 5, the electrophotographic processing unit 18 includes a casing 19 made of a synthetic resin material, and various devices and mechanisms necessary for electrophotographic processing except a fixing device are contained within the casing 19. In particular, an endless OPC (organic photo conductor) belt 22 is located within the casing 19 and supported at widthwise opposite marginal portions (non-print receiving portions) thereof by means of a plurality of guide rollers 20. The OPC belt 22 is driven to circulate in a direction indicated by an arrow mark A by a driving roller 21. The OPC belt 22 has a width sufficient to allow a picture image for a print line to be formed on the OPC belt 22. Located inside the OPC belt 22 within the casing 19 are, as listed in the direction of the arrow mark A, a charger 23 for uniformly charging the OPC belt 22, an LED (light emitting diode) head 24 for forming an electrostatic latent image on the OPC belt 22 charged uniformly by the charger 23 in accordance with information of a print pattern supplied from a controller not shown, a developing unit 25 for depositing toner powder T onto the OPC belt 22 to develop the electrostatic laten image formed on the OPC belt 22, a transfer station 26 for transferring the tone image on the OPC belt 22 to a paper sheet P, a discharger 27 for removing the remaining potential on the OPC belt 22, and a cleaner 28 for removing the toner T remaining on the OPC belt 22.

The LED head 24 includes a plurality of light emitting elements or diodes arranged in a row in a direction perpendicular to the direction of circulation of the OPC belt 22. Meanwhile, the developing unit 25 includes a developing roller 29 which is rotated to carry toner powder T from thereabove to the OPC belt 22 therebelow and cause the toner powder T to adhere to the OPC belt 22. The developing unit 25 is supplied with toner powder T from a hopper 30 located inside the OPC belt 22, and an agitator 31 is located within the hopper 30. In the meantime, the cleaner 28 includes a sponge roll 34 mounted in contact with the OPC belt 22, a magnet roll 33 for attracting toner powder T adhering to the sponge roll 34, and a blade 32 for taking off toner powder T attracted to the magnet roll 33. Toner powder T taken off by the blade 32 drops into the hopper 30 and is then agitated together with new toner powder T by the agitator 31.

The transfer station 26 is provided to cause a toner image to adhere to an upper face of a paper sheet P, and to this end, it includes a transfer device 35 located inside the OPC belt 22. A paper path 38 is formed between the transfer device 35 and an upper span of the OPC belt 22 such that a paper sheet P introduced thereinto via a pair of horizontally extending slits 37 formed in opposite side walls 36 of the casing 19 may pass therethrough. Meanwhile, a partition wall 39 is located between the transfer device 35 and a lower span of the OPC belt 22 for eliminating an influence of the transfer device 35 upon the lower span of the OPC belt 22. It is to be noted that the paper path 38 is located in line with the paper path 14A.

Referring back to FIG. 2, a fixing device 40 is located on the paper transport device 5 for fixing toner powder T on the paper sheet P discharged from the electrophotographic processing unit 18 to the surface of the paper sheet P. The fixing device 40 includes, as shown in detail in FIG. 2, a heat roll 41 containing therein a heat source not shown for generating heat, and a pressure roll 42 for contacting under pressure with the heat roll 41 from below. Thus, a paper sheet P fed out from an opposing one of the slits 37 of the electrophotographic processing unit 18 is put between the head roll 41 and the pressure roll 42 so that toner powder T is fixed to the upper surface of the paper sheet P by heat and mechanical pressure.

Now, operation of the printer of the embodiment described above will be described.

At first, when printing is to be performed by the print head 3 within the printer body 1, the change-over pawl 15 is positioned to a position as indicated by a solid line in FIG. 1 so that a paper sheet P from the supply paper tray 10 may be introduced into he downwardly directed paper path 14B. Then, the paper supply roller 12 is driven to rotate to introduce an uppermost one of paper sheets P within the supply paper tray 10 into the paper path 14B until it is positioned at the print position between the platen 2 and the print head 3 within the printer body 1. After then, printing by the print head 3 and intermittent transportation of the paper sheet P are repeated to effect intended printing. After completion of the intended printing, the paper sheet P is discharged onto the discharge paper tray 11.

On the other hand, when printing of a toner image is to be effected, at first the change-over pawl 15 is positioned to the other position indicated in phantom in FIG. 2, and then the paper supply roller 12 is driven to rotate to introduce an uppermost one of paper sheets P within the supply paper tray 10 into the paper path 14A whereafter the paper sheet P is fed into the electrophotographic processing unit 18 via an opposing one of the slits 37 of the unit 18 by rotation of the transport rollers 13 until it is stopped by a stopper not shown just when it arrives at a position in which a portion of the paper sheet P at which it is to be printed opposes to the OPC belt 22 within the casing 19. In this condition, the OPC belt 22 of the electrophotographic processing unit 18 is driven to circulate in the direction of the arrow mark A. Consequently, the OPC belt 22 is charged by the charger 23, and then an electrostatic latent image is formed on the thus charged OPC belt 22 by the LED head 24 in accordance with information of a print pattern supplied from the controller not shown. Subsequently, toner powder is caused to adhere to the electrostatic latent image by the developing unit 25 to form a toner image for a print line on the OPC belt 22. When the toner image on the OPC belt 22 arrives at the transfer station 26, the transfer device 35 is energized to transfer the toner image on the OPC belt 22 to an upper surface of the paper sheet P. After transfer of toner powder T of the toner image, the OPC belt 22 is caused to discharge the remaining potential therefrom by the discharger 27, and then the remaining toner powder T is removed from the OPC belt 22 by the cleaner 28, whereafter the OPC belt 22 returns to its initial position. After formation of the toner image for a print line on the paper sheet P in this manner, the transfer rollers 13 are driven again to transport the paper sheet P by one line space distance, and then another toner image is formed on the OPC belt 22 and transferred to the upper surface of the paper sheet P in a similar process as described above. As such a sequence of printing of a print line by the electrophotographic processing and intermittent transportation of the paper sheet P is repeated to progress printing, the paper sheet P gradually approaches the fixing device 40 and finally is put between the heat roll 41 and the pressure roll 42 of the fixing device 40. Consequently, as the paper sheet P is further transported intermittently, the toner powder T on the upper surface of the paper sheet P is fixed line by line to the upper surface of the paper sheet P by heat and mechanical pressure of the heat roll 41 and the pressure roll 42. Such intermittent transportation of the paper sheet P is continued until after completion of intended printing on the paper sheet P by the electrophotographic processing unit 18, and after completion of the intended printing, the heat roll 41 and the pressure roll 42 are continuously rotated to discharge the printed paper sheet P onto the discharge paper tray 11 together with rotation of the transport rollers 13 of the discharge paper tray 11.

In this manner, according to the present embodiment, it is possible to introduce a paper sheet P into the printer body 1 in order to effect impact printing with the print head 3 as well as to pass a paper sheet P through the electrophotographic processing unit 18 in order to effect non-impact printing with the electrophotographic processing unit 18. Accordingly, advantages of both printing methods can be made the most of.

It is to be noted that, while in the embodiment described above the developing unit is described as electrophotographic processing unit 18, a toner image may otherwise be formed by an electrostatic method or else by a magnetic method. Where the electrostatic method is employed to form an electrostatic latent image, the belt serving as a latent image forming means may be an electrostatic belt and an electrostatic latent image may be formed on the electrostatic belt by means of a multi-stylus electrode head. Meanwhile, where a toner image is to be formed by the magnetic method, the belt may be a magnetic belt and an electrostatic latent image may be formed on the magnetic belt by means of a magnetic head.

As apparent from the foregoing description, a printer according to the present invention exhibits an effect that impact printing and non-impact printing can be selectively performed thereon as required.

Having now fully described the invention, it will be apparent to one of ordinary skill in the art that may changes and modifications can be made thereto without departing from the spirit and scope of the invention as set forth herein.

What is claimed is:

1. A printer of the type which includes a printer body in which a print head is located in an opposing relationship to a platen, and a paper transport device mounted on said printer body and including a paper supply section for supplying one of paper sheets of a predetermined width stored in a pile on a supply paper tray to a print position between said print head and said platen in said printer body, and a paper discharging section for discharging a paper sheet from the print position onto a discharge paper tray, said printer comprising a developing unit located between said paper supply station and said paper discharging station of said paper transport device and including a latent image forming means in the form of a belt having a smaller width than the width of the paper sheets, a transfer station for transferring a toner image formed on said latent image forming means to a paper sheet, and means defining a paper path for passing a paper sheet through said transfer station, and a fixing device located outside said developing unit for fixing a toner image on a paper sheet discharged from said developing unit to a surface of the paper sheet.

2. A printer according to claim 1, wherein said latent image forming means of said developing unit is a photosensitive belt on which a latent image is formed by an optical writing head.

3. A printer according to claim 1, wherein said latent image forming means of said developing unit is an electrostatic belt on which a latent image is formed by a multi-stylus electrode head.

4. A printer according to claim 1, wherein said latent image forming means of said developing unit is a magnetic belt on which a latent image is formed by a magnetic head.

5. A printer according to claim 1, wherein said paper transport device has a first paper path for introducing a paper sheet from said supply paper tray into said paper path of said developing unit, and a second paper path for introducing a paper sheet from said supply paper tray to the print position between said print head and said platen.

6. A printer according to claim 5, wherein said paper transport device includes means for selecting one of said first and second paper paths of said paper transport device into which a paper sheet is to be introduced from said supply paper tray.

7. A printer according to claim 5, wherein said first paper path of said paper transport device, said paper path of said developing unit and said fixing device are located in line with one another.

8. A printer according to claim 1, wherein a paper sheet is transported in said paper path of said developing unit in a direction perpendicular to the direction of circulation of said belt.

9. A printer according to claim 1, wherein said paper transport device has a paper path for introducing a paper sheet from said supply paper tray into said paper path of said developing unit, said paper paths of said paper transport device and said developing unit extending in a substantially horizontal direction in line with each other.

* * * * *